US011830427B2

(12) United States Patent
Liu et al.

(10) Patent No.: US 11,830,427 B2
(45) Date of Patent: Nov. 28, 2023

(54) PIXEL CIRCUIT, DISPLAY APPARATUS AND DRIVING METHOD

(71) Applicants: Ordos Yuansheng Optoelectronics Co., Ltd., Inner Mongolia (CN); BOE Technology Group Co., Ltd., Beijing (CN)

(72) Inventors: Jing Liu, Beijing (CN); Zihua Li, Beijing (CN)

(73) Assignees: Ordos Yuansheng Optoelectronics Co., Ltd., Inner Mongolia (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/780,237

(22) PCT Filed: Jan. 19, 2021

(86) PCT No.: PCT/CN2021/072725
§ 371 (c)(1),
(2) Date: May 26, 2022

(87) PCT Pub. No.: WO2021/143930
PCT Pub. Date: Jul. 22, 2021

(65) Prior Publication Data

US 2022/0415257 A1 Dec. 29, 2022

(30) Foreign Application Priority Data

Jan. 19, 2020 (CN) ..... 202010059546.X

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01);
(Continued)

(58) Field of Classification Search
None
See application file for complete search history.

(56) References Cited

U.S. PATENT DOCUMENTS

2014/0333599 A1 11/2014 Lee et al.
2016/0125808 A1* 5/2016 Hsu ..... G09G 3/3233 345/212

(Continued)

FOREIGN PATENT DOCUMENTS

CN 204680360 U 9/2015
CN 106558287 A 4/2017

(Continued)

OTHER PUBLICATIONS

CN202010059546.X first office action.

(Continued)

*Primary Examiner* — Sepehr Azari
(74) *Attorney, Agent, or Firm* — IPro, PLLC

(57) ABSTRACT

Provided are a pixel circuit, a display apparatus and a driving method. In one type of pixel circuit, a first switch transistor is arranged between a gate electrode of a driving transistor and a second electrode of a first reset transistor, such that a leak current of the first reset transistor has a relatively small influence on a gate signal of the driving transistor. In other types of pixel circuit, a second reset transistor for short-circuiting the gate electrode and a first electrode is provided, such that the resetting of an anode of a light-emitting device is only related to a signal of a second reset signal end. Therefore, the voltage difference between two ends of a third reset transistor can be reduced by means of adjusting a signal voltage of a reference voltage signal end.

14 Claims, 7 Drawing Sheets

(52) U.S. Cl.
CPC ..... *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2330/021* (2013.01)

(56) References Cited

U.S. PATENT DOCUMENTS

| | | | | |
|---|---|---|---|---|
| 2017/0270853 | A1* | 9/2017 | Xiang | G09G 3/3258 |
| 2017/0301293 | A1 | 10/2017 | Zhu et al. | |
| 2018/0268760 | A1 | 9/2018 | Chen et al. | |
| 2019/0206320 | A1* | 7/2019 | Nam | G09G 3/3258 |
| 2020/0388214 | A1* | 12/2020 | Yang | G09G 3/3233 |
| 2022/0327998 | A1 | 10/2022 | Liu et al. | |

FOREIGN PATENT DOCUMENTS

| | | | |
|---|---|---|---|
| CN | 107316613 | A | 11/2017 |
| CN | 108053792 | A | 5/2018 |
| CN | 108288457 | A | 7/2018 |
| CN | 108831383 | A | 11/2018 |
| CN | 109036250 | A | 12/2018 |
| CN | 109215582 | A | 1/2019 |
| CN | 109215585 | A | 1/2019 |
| CN | 110223640 | A | 9/2019 |
| CN | 110675816 | A | 1/2020 |
| CN | 111243526 | A | 6/2020 |

OTHER PUBLICATIONS

CN202010059546.X second office action.
CN202010059546.X Decision of Rejection.
PCT/CN2021/072725 international search report and written opinion.

* cited by examiner

PIXEL CIRCUIT, DISPLAY APPARATUS AND DRIVING METHOD

CROSS REFERENCE TO RELATED APPLICATION

The present disclosure is a US National Stage of International Application No. PCT/CN2021/072725, filed on Jan. 19, 2021, which claims the priority of Chinese patent application No. 202010059546.X filed to the Chinese Patent Office on Jan. 19, 2020 and entitled "PIXEL CIRCUIT, DISPLAY APPARATUS AND DRIVING METHOD", which is incorporated in its entirety herein by reference.

FIELD

The present disclosure relates to the field of displays, in particular to a pixel circuit, a display apparatus and a driving method.

BACKGROUND

With bend property, high contrast and low power consumption, organic light emitting diode (OLED) panels have attracted extensive attention. Pixel circuits, as core technologies of OLED panels, have crucial research significance. Generally, drive transistors in pixel circuits generate currents to drive OLEDs in OLED panels to emit light.

SUMMARY

An embodiment of the present disclosure provides a driving method of a pixel circuit. The pixel circuit includes: a drive transistor; a storage capacitor, where a first electrode of the storage capacitor is electrically connected to a first power supply terminal, and a second electrode of the storage capacitor is electrically connected to a gate electrode of the drive transistor; a first switch transistor, where a first electrode of the first switch transistor is electrically connected to a first electrode of the drive transistor, a gate electrode of the first switch transistor is electrically connected to a first scanning signal terminal, and a second electrode of the first switch transistor is electrically connected to the gate electrode of the drive transistor; and a first reset transistor, where a first electrode of the first reset transistor is electrically connected to a reference voltage signal terminal, a gate electrode of the first reset transistor is electrically connected to a first reset signal terminal, and a second electrode of the first reset transistor is electrically connected to the first electrode of the first switch transistor.

The driving method includes: in a first stage, loading an active level signal to the first reset signal terminal and loading a cut-off level signal to the first scanning signal terminal; in a second stage, loading an active level signal to the first reset signal terminal and loading an active level signal to the first scanning signal terminal; in a third stage, loading a cut-off level signal to the first reset signal terminal and loading an active level signal to the first scanning signal terminal; and in a fourth stage, loading a cut-off level signal to the first reset signal terminal and loading a cut-off level signal to the first scanning signal terminal.

Optionally, the pixel circuit further includes: a second switch transistor, where a first electrode of the second switch transistor is electrically connected to the first power supply terminal, a gate electrode of the second switch transistor is electrically connected to a light emission control signal terminal, and a second electrode of the second switch transistor is electrically connected to a second electrode of the drive transistor; a light emitting device, where a cathode of the light emitting device is electrically connected to a second power supply terminal; and a third switch transistor, where a first electrode of the third switch transistor is electrically connected to the first electrode of the drive transistor, a gate electrode of the third switch transistor is electrically connected to the light emission control signal terminal, and a second electrode of the third switch transistor is electrically connected to an anode of the light emitting device.

The driving method further includes: in the first stage, loading an active level signal to the light emission control signal terminal; in the second stage, loading a cut-off level signal to the light emission control signal terminal; in the third stage, loading a cut-off level signal to the light emission control signal terminal; and in the fourth stage, loading an active level signal to the light emission control signal terminal.

Optionally, the pixel circuit further includes: a fourth switch transistor, where a first electrode of the fourth switch transistor is electrically connected to a data signal terminal, a gate electrode of the fourth switch transistor is electrically connected to a second scanning signal terminal, and a second electrode of the fourth switch transistor is electrically connected to a second electrode of the drive transistor.

The driving method further includes: in the first stage, loading a cut-off level signal to the second scanning signal terminal; in the second stage, loading a cut-off level signal to the second scanning signal terminal; in the third stage, loading an active level signal to the second scanning signal terminal; and in the fourth stage, loading a cut-off level signal to the second scanning signal terminal.

Optionally, all the transistors in the pixel circuit are P-type transistors, the active level signal is a low level signal, and the cut-off level signal is a high level signal.

An embodiment of the present disclosure provides another pixel circuit. The pixel circuit includes: a drive transistor; a storage capacitor, where a first electrode of the storage capacitor is electrically connected to a first power supply terminal, and a second electrode of the storage capacitor is electrically connected to a gate electrode of the drive transistor; a light emitting device, where a cathode of the light emitting device is electrically connected to a second power supply terminal; a fifth switch transistor, where a first electrode of the fifth switch transistor is electrically connected to a first electrode of the drive transistor, a gate electrode of the fifth switch transistor is electrically connected to a light emission control signal terminal, and a second electrode of the fifth switch transistor is electrically connected to an anode of the light emitting device; a second reset transistor, where a gate electrode and a first electrode of the second reset transistor are both electrically connected to a second reset signal terminal, and a second electrode of the second reset transistor is electrically connected to the anode of the light emitting device; and a third reset transistor, where a first electrode of the third reset transistor is electrically connected to a reference voltage signal terminal, a gate electrode of the third reset transistor is electrically connected to a third reset signal terminal, and a second electrode of the third reset transistor is electrically connected to the gate electrode of the drive transistor.

Optionally, the pixel circuit further includes: a sixth switch transistor, where a first electrode of the sixth switch transistor is electrically connected to the first electrode of the drive transistor, a gate electrode of the sixth switch transistor is electrically connected to a scanning signal terminal, and a second electrode of the sixth switch transistor is electrically connected to the gate electrode of the drive transistor.

Optionally, the pixel circuit further includes: a seventh switch transistor, where a first electrode of the seventh switch transistor is electrically connected to a data signal terminal, a gate electrode of the seventh switch transistor is electrically connected to the scanning signal terminal, and a second electrode of the seventh switch transistor is electrically connected to a second electrode of the drive transistor.

Optionally, the pixel circuit further includes: an eighth switch transistor, where a first electrode of the eighth switch transistor is electrically connected to the first power supply terminal, a gate electrode of the eighth switch transistor is electrically connected to the light emission control signal terminal, and a second electrode of the eighth switch transistor is electrically connected to a second electrode of the drive transistor.

Optionally, a difference between a maximum signal voltage of the reference voltage signal terminal and a minimum signal voltage of the data signal terminal is less than a threshold voltage of the drive transistor.

In another aspect, an embodiment of the present disclosure further provides a display apparatus. The display apparatus includes the above pixel circuit.

In another aspect, an embodiment of the present disclosure further provides a driving method of the above pixel circuit. The driving method includes: in a first stage, loading an active level signal to a third reset signal terminal, loading a cut-off level signal to a second reset signal terminal and loading a cut-off level signal to a light emission control signal terminal; in a second stage, loading a cut-off level signal to the third reset signal terminal, loading an active level signal to the second reset signal terminal and loading a cut-off level signal to the light emission control signal terminal; and in a third stage, loading a cut-off level signal to the third reset signal terminal, loading a cut-off level signal to the second reset signal terminal and loading an active level signal to the light emission control signal terminal.

Optionally, the driving method further includes: in the first stage, loading a cut-off level signal to the scanning signal terminal; in the second stage, loading an active level signal to the scanning signal terminal; and in a third stage, loading a cut-off level signal to the scanning signal terminal.

DETAILED DESCRIPTION OF THE EMBODIMENTS

Figure 1:
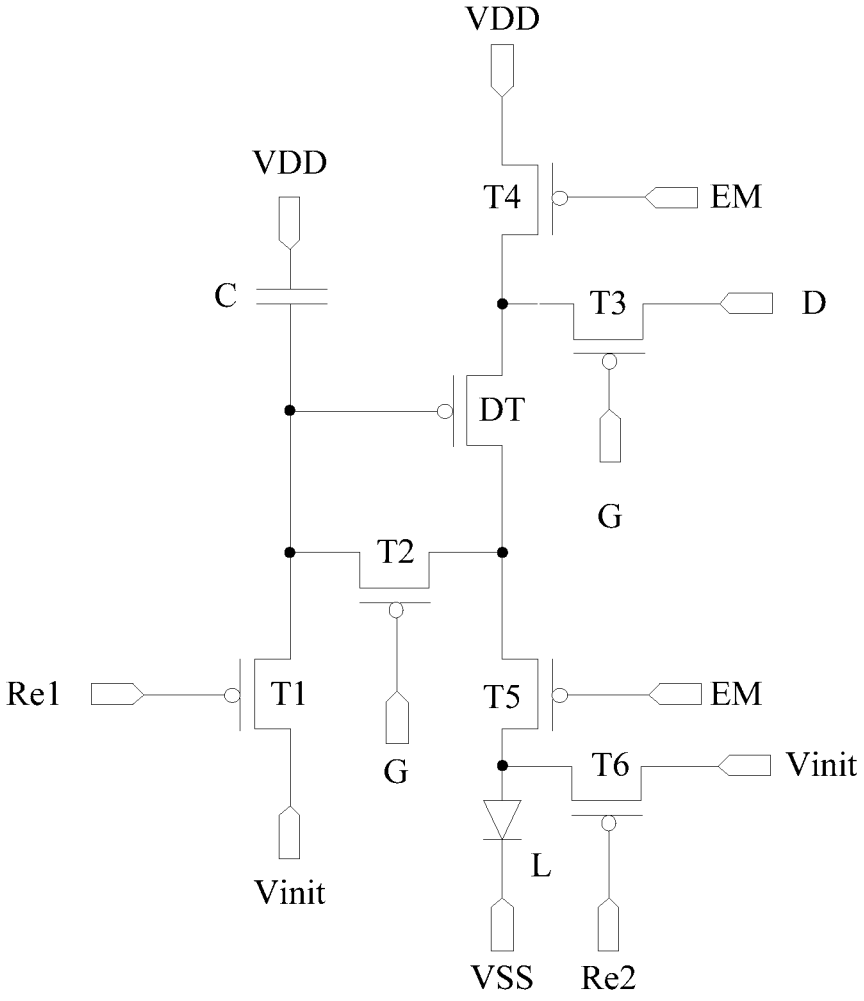
FIG. 1 is a schematic diagram of a pixel circuit provided in the related art.

In order to make the objectives, technical solutions and advantages of embodiments of the present disclosure more obvious, the technical solutions of the present disclosure will be clearly and completely described below in combination with the accompanying drawings in the embodiments of the present disclosure. Apparently, the described embodiments are merely some rather than all of the embodiments of the present disclosure. The embodiments of the present disclosure and the features in the embodiments may be combined with each other without conflict. On the basis of the described embodiments of the present disclosure, all other embodiments obtained by those skilled in the art without making creative efforts fall within the scope of protection of the present disclosure.

Unless otherwise defined, technical terms or scientific terms used in the present disclosure should have the ordinary meanings understood by those of ordinary skill in the art to which the present disclosure belongs. "First", "second" and other similar words used in the present disclosure do not indicate any order, quantity or importance, but are merely used to distinguish between different components. "Comprise", "include" or other similar words mean that an element or object appearing before the word contains elements or objects listed after the word and equivalents thereof, without excluding other elements or objects. "Connect", "connected" or other similar words are not limited to physical or mechanical connections, but may include electrical connections, whether direct or indirect.

It should be noted that sizes and shapes of all patterns in the accompanying drawings do not reflect true scale and are merely intended to illustrate the contents of the present disclosure. Moreover, from beginning to end, identical or similar reference numerals denote identical or similar elements or elements having identical or similar functions.

Generally, a pixel circuit includes a transistor for resetting a gate electrode of a drive transistor and a transistor for resetting an anode of a light emitting device. For example, as shown in FIG. 1, a pixel circuit includes a drive transistor DT, a light emitting device L, a first transistor T1 to a sixth transistor T6, and a capacitor C. A first electrode of the capacitor C is electrically connected to a first power supply terminal VDD, and a second electrode of the capacitor C is electrically connected to a gate electrode of the drive transistor DT. A first electrode of the first transistor T1 is electrically connected to a reference voltage signal terminal Vinit, a gate electrode of the first transistor T1 is electrically connected to a first reset signal terminal Re1, and a second electrode of the first transistor T1 is electrically connected to the gate electrode of the drive transistor DT. A first electrode of a second transistor T2 is electrically connected to a first electrode of the drive transistor DT, a gate electrode of the second transistor T2 is electrically connected to a scanning signal terminal G, and a second electrode of the second transistor T2 is electrically connected to the gate electrode of the drive transistor DT. A first electrode of a third transistor T3 is electrically connected to a data signal terminal D, a gate electrode of the third transistor T3 is electrically connected to the scanning signal terminal G, and a second electrode of the third transistor T3 is electrically connected to the second electrode of the drive transistor DT. A first electrode of a fourth transistor T4 is electrically connected to the first power supply terminal VDD, a gate electrode of the fourth transistor T4 is electrically connected to a light emission control signal terminal EM, and a second electrode of the fourth transistor T4 is electrically connected to the second electrode of the drive transistor DT. A first electrode of a fifth transistor T5 is electrically connected to the first electrode of the drive transistor DT, a gate electrode of the fifth transistor T5 is electrically connected to the light emission control signal terminal EM, and a second electrode of the fifth transistor T5 is electrically connected to an anode of the light emitting device L. A first electrode of a sixth transistor T6 is electrically connected to the reference voltage signal terminal Vinit, a gate electrode of the sixth transistor T6 is electrically connected to a second reset signal terminal Re2, and a second electrode of the sixth transistor T6 is electrically connected to the anode of the light emitting device L. A cathode of the light emitting device L is electrically connected to a second power supply terminal VSS.

Specifically, the first transistor T1 is used for providing a signal of the reference voltage signal terminal Vinit for the gate electrode of the drive transistor DT under the control of a signal of the first reset signal terminal Re1, and the sixth transistor T6 is used for providing the signal of the reference voltage signal terminal Vinit for the anode of the light emitting device L under the control of a signal of the second reset signal terminal Re2.

During specific implementation, as shown in FIG. 1, the first transistor T1 to the sixth transistor T6 are all P-type transistors. The first transistor T1 to the sixth transistor T6 may also be all N-type transistors, which is not limited herein.

Figure 2:
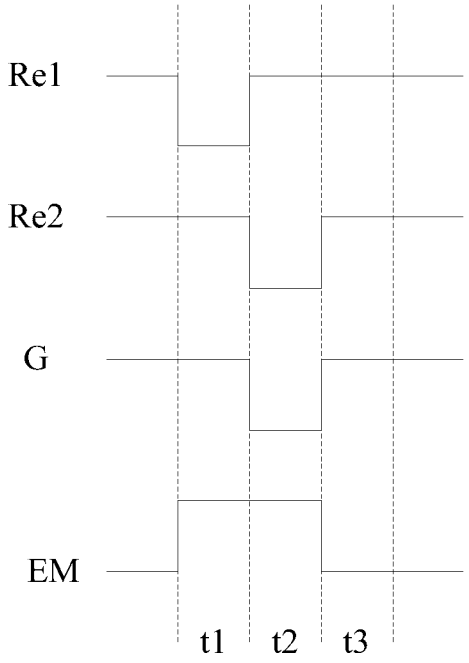
FIG. 2 is a signal timing diagram provided in the related art.

A working process of the pixel circuit shown in FIG. 1 will be described below by selecting three stages, that is, a first stage t1, a second stage t2 and a third stage t3 in a signal timing diagram shown in FIG. 2. In the following description, 1 represents a high level and 0 represents a low level. It should be noted that 1 and 0 are logic levels, which are merely for better explanation of the specific working process of the pixel circuit, not specific voltage values. A signal voltage of the reference voltage signal terminal Vinit is Vi, a signal voltage of the data signal terminal D is VD, a threshold voltage of the drive transistor DT is Vth, and a signal voltage of the first power supply terminal VDD is Vdd.

In the first stage t1, Re1=0, Re2=1, G=1 and EM=1.

When Re1=0, the first transistor T1 is turned on; when Re2=1, the sixth transistor T6 is turned off; when G=1, the second transistor T2 and the third transistor T3 are turned off; when EM=1, the fourth transistor T4 and the fifth transistor T5 are turned off; and the first transistor T1 provides the signal of the reference voltage signal terminal Vinit to the gate electrode of the drive transistor DT to reset the gate electrode.

In the second stage t2, Re1=1, Re2=0, G=0 and EM=1.

When Re1=1, the first transistor T1 is turned off; when Re2=0, the sixth transistor T6 is turned on; when G=0, the second transistor T2 and the third transistor T3 are turned on; when EM=1, the fourth transistor T4 and the fifth transistor T5 are turned off; and the gate electrode and the first electrode of the drive transistor DT are turned on to form a diode, the data signal terminal D charges the gate electrode of the drive transistor DT and the capacitor C until a gate electrode voltage of the drive transistor DT is VD+Vth, and the drive transistor DT is turned off. The sixth transistor T6 provides the signal of the reference voltage signal terminal Vinit for the anode of the light emitting device L to reset the anode.

In the third stage t3, Re1=1, Re2=1, G=1 and EM=0.

When Re1=1, the first transistor T1 is turned off; when Re2=1, the sixth transistor T6 is turned off; when G=1, the second transistor T2 and the third transistor T3 are turned off; when EM=0, the fourth transistor T4 and the fifth transistor T5 are turned on; and the drive transistor DT generates a drive current under the control of the gate electrode voltage and a source electrode voltage thereof, so as to drive the light emitting device L to emit light.

The drive current I satisfies the following formula:

$$I=K(Vgs-Vth)^2=K(VD+Vth-Vdd-Vth)^2=K(VD-Vdd)^2.$$

Wherein, $$K=\frac{1}{2}\mu_n C_{ox}\frac{W}{L},$$

$\mu_n$ represents a migration rate of the drive transistor DT, $C_{ox}$ represents a capacitance of a gate oxide layer per unit area, and $$\frac{W}{L}$$

represents a width-length ratio of the drive transistor DT. In the same structure, these values are relatively stable and may be regarded as constants.

In the third stage t3, that is, in a light emission stage, a voltage difference between two ends of the first transistor T1 is (VD+Vth)−Vi. In practical application, the voltage difference is relatively large, such that electric leakage is likely to occur on the first transistor T1, stability of the gate electrode voltage of the drive transistor DT may be influenced, and a display defect may be caused. Specifically, due to electric leakage of the first transistor T1, the gate electrode voltage of the drive transistor DT may be lowered, such that the drive current of the drive transistor DT may be increased, and a bright dot defect may be caused.

Illustratively, the signal voltage Vdd of the first power supply terminal VDD may be 4.6V, the signal voltage Vi of the reference voltage signal terminal Vinit may be −3V, the threshold voltage of the drive transistor DT may be −1V, and a minimum signal voltage of the data signal terminal D may be 3V, such that the voltage difference between the two ends of the first transistor T1 is at least 5V, and a leakage current of the first transistor T1 is relatively large. When a signal voltage of the data signal terminal D is increased, the leakage current of the first transistor T1 will be further increased.

Figure 3:
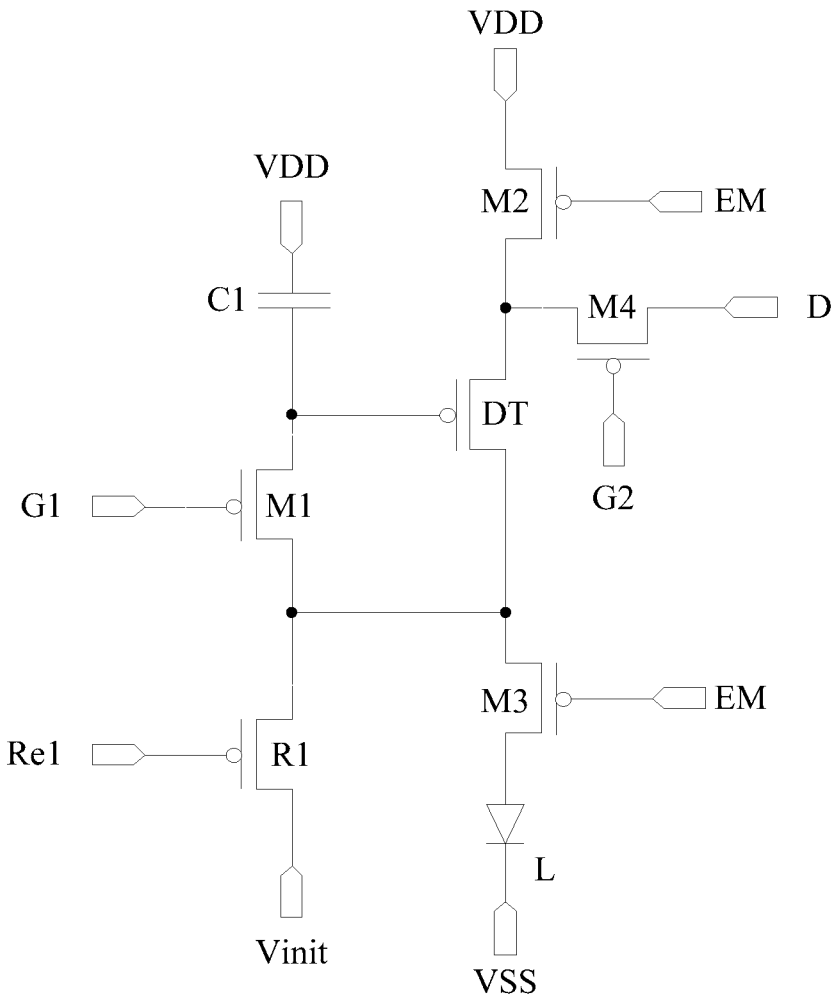
FIG. 3 is a schematic diagram of a pixel circuit provided in an embodiment of the present disclosure.

In order to solve the problem of the bright dot defect caused by the electric leakage of the first transistor T1, an embodiment of the present disclosure provides a pixel circuit. As shown in FIG. 3, the pixel circuit includes a drive transistor DT, a storage capacitor C1, a first switch transistor M1 and a first reset transistor R1.

A first electrode of the storage capacitor C1 is electrically connected to a first power supply terminal VDD, and a second electrode of the storage capacitor C1 is electrically connected to a gate electrode of the drive transistor DT.

A first electrode of the first switch transistor M1 is electrically connected to a first electrode of the drive transistor DT, a gate electrode of the first switch transistor M1 is electrically connected to a first scanning signal terminal G1, and a second electrode of the first switch transistor M1 is electrically connected to the gate electrode of the drive transistor DT.

A first electrode of the first reset transistor R1 is electrically connected to a reference voltage signal terminal Vinit, a gate electrode of the first reset transistor R1 is electrically connected to a first reset signal terminal Re1, and a second electrode of the first reset transistor R1 is electrically connected to the first electrode of the first switch transistor M1.

According to the above pixel circuit provided in the embodiment of the present disclosure, the first switch transistor M1 is arranged between the gate electrode of the drive transistor DT and the second electrode of the first reset transistor R1, so that the gate electrode of the drive transistor DT is not directly electrically connected to the first reset transistor R1, and a leakage current of the first reset transistor R1 has a relatively smaller influence on a gate electrode signal of the drive transistor DT, thereby overcoming a display defect caused by the electric leakage of the first reset transistor R1.

During specific implementation, the first switch transistor M1 is turned on under the control of a signal of the first scanning signal terminal G1 such that the gate electrode of the drive transistor DT and the second electrode of the drive transistor DT may be turned on, and a signal of the reference voltage signal terminal Vinit may be provided to the second electrode of the drive transistor DT.

During specific implementation, when the gate electrode of the drive transistor DT is in a floating state, the storage capacitor C1 may store a signal of a gate electrode of the drive transistor DT.

Figure 5:
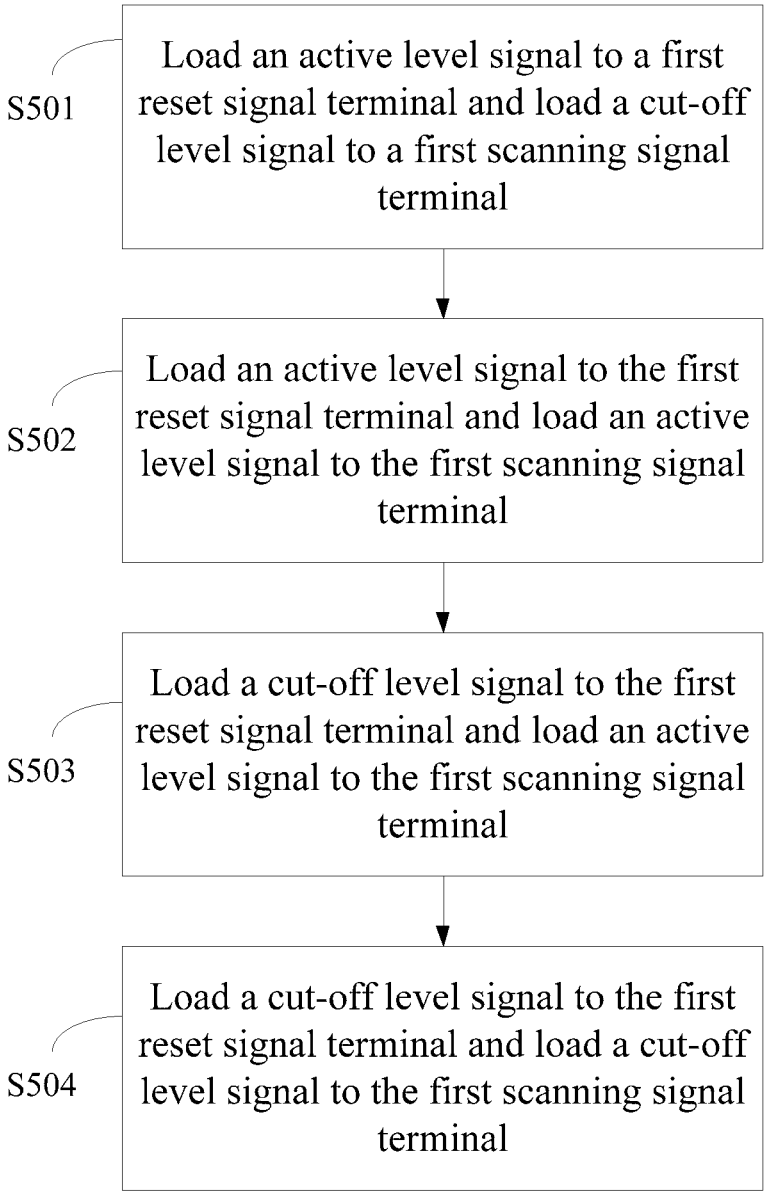
FIG. 5 is a flowchart of a driving method provided in an embodiment of the present disclosure.

On the basis of the same inventive concept, an embodiment of the present disclosure further provides a driving method of the pixel circuit. As shown in FIG. 5, the driving method includes S501 to S504.

S501, load an active level signal to the first reset signal terminal and load a cut-off level signal to the first scanning signal terminal in a first stage.

S502, load an active level signal to the first reset signal terminal and load an active level signal to the first scanning signal terminal in a second stage.

S503, load a cut-off level signal to the first reset signal terminal and load an active level signal to the first scanning signal terminal in a third stage.

S504, load a cut-off level signal to the first reset signal terminal and load a cut-off level signal to the first scanning signal terminal in a fourth stage.

Optionally, as shown in FIG. 3, the pixel circuit provided in the embodiment of the present disclosure may further include a second switch transistor M2, a third switch transistor M3 and a light emitting device L.

A first electrode of the second switch transistor M2 is electrically connected to the first power supply terminal VDD, a gate electrode of the second switch transistor M2 is electrically connected to a light emission control signal terminal EM, and a second electrode of the second switch transistor M2 is electrically connected to a second electrode of the drive transistor DT.

A first electrode of the third switch transistor M3 is electrically connected to the first electrode of the drive transistor DT, a gate electrode of the third switch transistor M3 is electrically connected to the light emission control signal terminal EM, a second electrode of the third switch transistor M3 is electrically connected to an anode of the light emitting device L, and a cathode of the light emitting device L is electrically connected to a second power supply terminal VSS.

During specific implementation, the second switch transistor M2 is turned on under the control of a signal of the light emission control signal terminal EM, so that the first power supply terminal VDD and the second electrode of the drive transistor DT may be turned on. The third switch transistor M3 is turned on under the control of a signal of the light emission control signal terminal EM, so that the first electrode of the drive transistor DT and the anode of the light emitting device L may be turned on, and the light emitting device L is driven by a current generated by the drive transistor DT to emit light.

Correspondingly, the driving method of the pixel circuit as provided in the embodiment of the present disclosure further includes the following operations.

Load an active level signal to the light emission control signal terminal in the first stage.

Load a cut-off level signal to the light emission control signal terminal in the second stage.

Load a cut-off level signal to the light emission control signal terminal in the third stage.

Load an active level signal to the light emission control signal terminal in the fourth stage.

Optionally, as shown in FIG. 3, the pixel circuit provided in the embodiment of the present disclosure further includes: a fourth switch transistor M4. A first electrode of the fourth switch transistor M4 is electrically connected to a data signal terminal D, a gate electrode of the fourth switch transistor M4 is electrically connected to a second scanning signal terminal G2, and a second electrode of the fourth switch transistor M4 is electrically connected to the second electrode of the drive transistor DT.

During specific implementation, when the fourth switch transistor M4 is turned on under the control of a signal of the second scanning signal terminal G2, the signal of the data signal terminal D may be provided to the second electrode of the drive transistor DT.

Correspondingly, the driving method of the pixel circuit as provided in the embodiment of the present disclosure further includes the following operations.

Load a cut-off level signal to the second scanning signal terminal in the first stage.

Load a cut-off level signal to the second scanning signal terminal in the second stage.

Load an active level signal to the second scanning signal terminal in the third stage.

Load a cut-off level signal to the second scanning signal terminal in the fourth stage.

Optionally, in the pixel circuit provided in the embodiment of the present disclosure, as shown in FIG. 3, the first reset transistor R1 and the first switch transistor M1 to the fourth switch transistor M4 may all be P-type transistors, or may all be N-type transistors, which is not limited herein.

Specifically, in the pixel circuit provided in the embodiment of the present disclosure, the P-type transistors are turned on under low level signals and are turned off under high level signals, and the N-type transistors are turned on under high level signals and are turned off under low level signals.

Therefore, in the case that all the transistors in the pixel circuit provided in the embodiment of the present disclosure are P-type transistors, the active level signals mentioned in the driving method are low level signals, and the cut-off level signals are high level signals.

Specifically, in the pixel circuit provided in the embodiment of the present disclosure, each of the transistors may be a thin film transistor (TFT) or a metal oxide semiconductor (MOS) field effect transistor, which is not limited herein. According to different types of the above transistors and different gate electrode signals of the transistors, the first electrode of each transistor may be used as a source electrode and a second electrode thereof may be used as a drain electrode, or the first electrode of each transistor may be used as a drain electrode and the second electrode thereof may be used as a source electrode, which are not specifically distinguished herein.

The present disclosure will be described in detail below in combination with specific embodiments. It should be noted that the embodiment is provided for better explanation of the present disclosure, but is not intended to limit the present disclosure. In the following description, 1 represents a high level and 0 represents a low level. It should be noted that 1 and 0 are logic levels, which are merely for better explanation of the specific working process of the pixel circuit, not specific voltage values.

Figure 4:
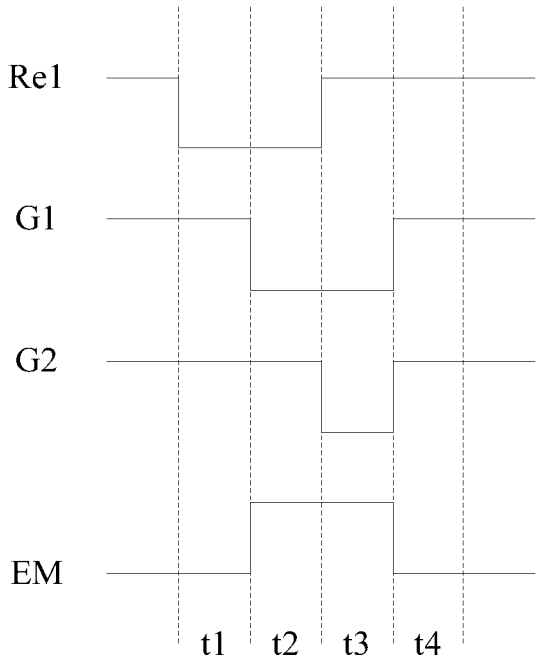
FIG. 4 is a signal timing diagram provided in an embodiment of the present disclosure.

With a structure of the pixel circuit shown in FIG. 3 as an example, working processes of the pixel circuit and the driving method thereof provided in the embodiments of the present disclosure will be described below in combination with a signal timing diagram shown in FIG. 4. Specifically, four stages, that is, a first stage t1, a second stage t2, a third stage t3 and a fourth stage t4 in the signal timing diagram shown in FIG. 4 are selected. A signal voltage of the reference voltage signal terminal Vinit is Vi, a signal voltage of the data signal terminal D is VD, a threshold voltage of the drive transistor DT is Vth, and a signal voltage of the first power supply terminal VDD is Vdd.

In the first stage t1, Re1=0, G1=1, G2=1 and EM=0.

When Re1=0, a first reset transistor R1 is turned on; when G1=1, a first switch transistor M1 is turned off; when G2=1, a fourth switch transistor M4 is turned off; and when EM=0, a second switch transistor M2 and a third switch transistor M3 are turned on. The second switch transistor M2 is turned on, so that a signal of the first power supply terminal VDD is provided to a second electrode of the drive transistor DT to reset the second electrode. The first reset transistor R1 and the third switch transistor M3 are turned on, so that a signal of the reference voltage signal terminal Vinit is provided to an anode of a light emitting device L by means of the first reset transistor R1 and the third switch transistor M3 to reset the anode.

In the second stage t2, Re1=0, G1=0, G2=1 and EM=1.

When Re1=0, the first reset transistor R1 is turned on; when G1=0, the first switch transistor M1 is turned on; when G2=1, the fourth switch transistor M4 is turned off; and when EM=1, the second switch transistor M2 and the third switch transistor M3 are turned off. The first reset transistor R1 and the first switch transistor M1 are turned on, so that the signal of the reference voltage signal terminal Vinit is provided to a gate electrode of the drive transistor DT by means of the first reset transistor R1 and the first switch transistor M1 to reset the gate electrode.

In the third stage t3, Re1=1, G1=0, G2=0 and EM=1.

When Re1=1, the first reset transistor R1 is turned off; when G1=0, the first switch transistor M1 is turned on; when G2=0, the fourth switch transistor M4 is turned on; and when EM=1, the second switch transistor M2 and the third switch transistor M3 are turned off. The first switch transistor M1 is turned on, and the gate electrode and the first electrode of the drive transistor DT are turned on to form a diode. The fourth switch transistor M4 is turned on, so that a signal of the data signal terminal D is provided to the second electrode of the drive transistor DT, the signal of the data signal terminal D charges the gate electrode of the drive transistor DT and a storage capacitor CC until the gate electrode voltage of the drive transistor DT is VD+Vth, and the drive transistor DT is turned off.

In the third stage, in the case that the first reset transistor R1 has a leakage current, since the signal of the data signal terminal D continuously charges the gate electrode of the drive transistor DT, an influence on a gate electrode signal voltage of the drive transistor DT is relatively smaller, which may be ignored.

In the fourth stage t4, Re1=1, G1=1, G2=1 and EM=0.

When Re1=1, the first reset transistor R1 is turned off; when G1=1, the first switch transistor M1 is turned off; when G2=1, the fourth switch transistor M4 is turned off; and when EM=0, the second switch transistor M2 and the third switch transistor M3 are turned on. The second switch transistor M2 and the third switch transistor M3 are turned on, and the drive transistor DT generates a drive current I to enable the light emitting device L to emit light.

The drive current I satisfies the following formula:

$$I=K(Vgs-Vth)^2=K(VD+Vth-Vdd-Vth)^2=K(VD-Vdd)^2.$$

Wherein, $$K=\frac{1}{2}\mu_n C_{ox}\frac{W}{L},$$

$\mu_n$ represents a migration rate of the drive transistor DT, $C_{ox}$ represents a capacitance of a gate oxide layer per unit area, $$\frac{W}{L}$$

represents a width-length ratio of the drive transistor DT. In the same structure, these values are relatively stable and may be regarded as constants.

In the fourth stage, by arranging the first switch transistor M1, an influence of a leakage current of the first reset transistor R1 on a gate electrode voltage of the drive transistor DT may be reduced, thereby overcoming a display defect caused by the leakage current of the first reset transistor R1. That is, even if the leakage current of the first reset transistor R1 may influence a drive current output by the first electrode of the drive transistor, only the drive current is reduced and brightness of the light emitting device L is reduced, so that an influence on a display effect is lower than an influence of a bright dot defect.

Specifically, in combination with the pixel circuit shown in FIG. 1, the signal voltage Vi of the reference voltage signal terminal Vinit is increased to reduce a voltage difference between two ends of the first transistor T1, so as to change the display defect caused by the electric leakage of the first transistor T1. However, in the second stage t2, the signal of the reference voltage signal terminal Vinit is provided to the anode of the light emitting device L. If the signal voltage Vi of the reference voltage signal terminal Vinit is relatively higher, and the difference between the signal voltage of the second power supply terminal VSS and the signal voltage Vi of the reference voltage signal terminal Vinit is relatively smaller, when the difference is less than a light emission starting voltage of the light emitting device (when a voltage difference between two ends of the light emitting device is larger than the light emission starting voltage, the light emitting device emits light), brightness of a black picture is relatively higher. If a second reference voltage signal terminal is additionally arranged to replace the reference voltage signal terminal to be electrically connected to the first electrode of the sixth transistor T6, and only the signal voltage Vi of the reference voltage signal terminal Vinit is increased, the number of signal lines will be increased, resulting in increased wiring difficulty and increased cost.

Figure 6:
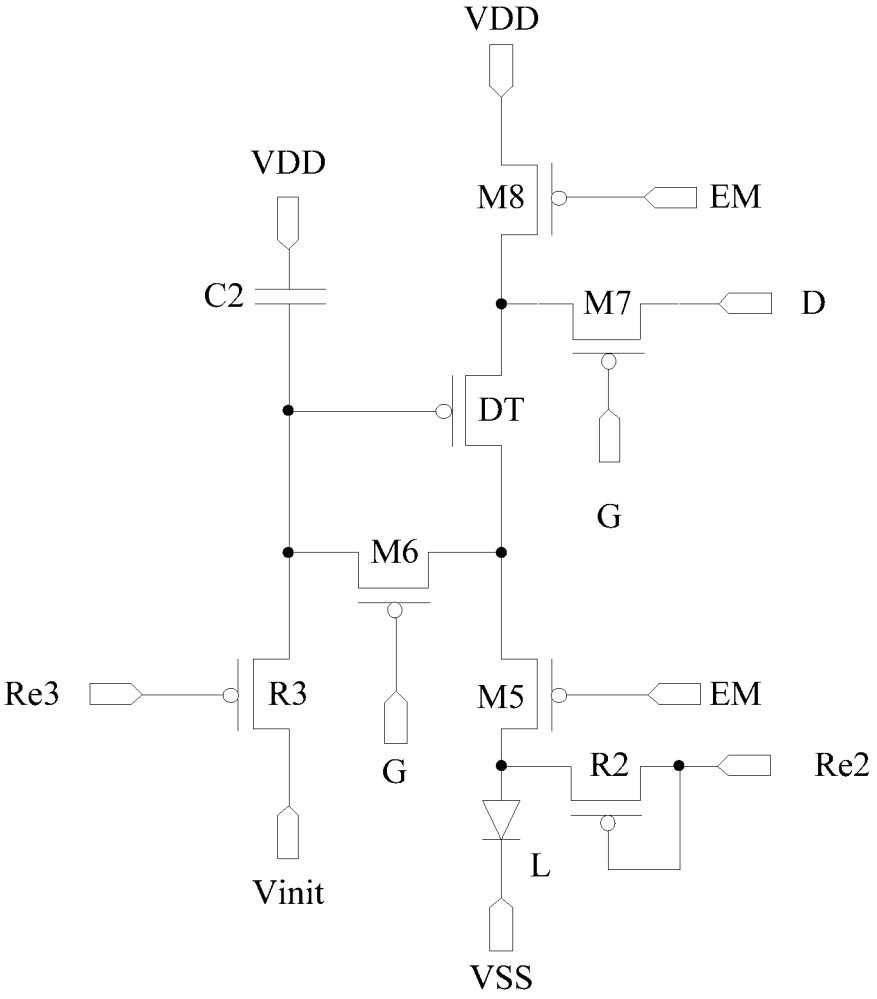
FIG. 6 is a schematic diagram of another pixel circuit provided in an embodiment of the present disclosure.

On the basis of this, an embodiment of the present disclosure further provides another pixel circuit. As shown in FIG. 6, the pixel circuit includes: a drive transistor DT, a storage capacitor C2, a light emitting device L, a fifth switch transistor M5, a second reset transistor R2 and a third reset transistor R3.

A first electrode of the storage capacitor C2 is electrically connected to a first power supply terminal VDD, and a second electrode of the storage capacitor C2 is electrically connected to a gate electrode of the drive transistor DT.

A first electrode of the fifth switch transistor M5 is electrically connected to a first electrode of the drive transistor DT, a gate electrode of the fifth switch transistor M5 is electrically connected to a light emission control signal terminal EM, a second electrode of the fifth switch transistor M5 is electrically connected to an anode of the light emitting device L, and a cathode of the light emitting device L is electrically connected to a second power supply terminal VSS.

A gate electrode and a first electrode of the second reset transistor R2 are both electrically connected to a second reset signal terminal Re2, and a second electrode of the second reset transistor R2 is electrically connected to the anode of the light emitting device L.

A first electrode of the third reset transistor R3 is electrically connected to a reference voltage signal terminal Vinit, a gate electrode of the third reset transistor R3 is electrically connected to a third reset signal terminal Re3, and a second electrode of the third reset transistor R3 is electrically connected to the gate electrode of the drive transistor DT.

According to the above pixel circuit provided in the embodiments of the present disclosure, the first electrode and the gate electrode of the second reset transistor R2 are short-circuited and then simultaneously connected to the second reset signal terminal Re2, so that reset of the anode of the light emitting device L is only related to the signal of the second reset signal terminal Re2 and is unrelated to the reference voltage signal terminal Vinit.

Specifically, according to the pixel circuit provided in the embodiment of the present disclosure, on the one hand, the signal voltage of the reference voltage signal terminal Vinit may be adjusted to reduce the voltage difference between two ends of the third reset transistor R3, to thereby reduce a leakage current of the third reset transistor R3, and further to improve a display effect. On the other hand, the gate electrode and the first electrode of the second reset transistor R2 are both electrically connected to the second reset signal terminal Re2, so that adjustment of the signal voltage of the reference voltage signal terminal Vinit does not influence reset of the anode of the light emitting device L, to ensure that the brightness of the black picture is sufficiently low.

During specific implementation, the second reset transistor R2 may reset the anode of the light emitting device L according to the signal of the second reset signal terminal Re2. Specifically, when the signal of the second reset signal terminal Re2 is a cut-off level signal (that is, a high level signal), the second reset transistor R2 is cut off. When the signal of the second reset transistor R2 is an active level signal (that is, a low level signal), the second reset transistor R2 is turned on, and the second reset signal terminal Re2 and the anode of the light emitting device L are turned on to reset the anode.

During specific implementation, the third reset transistor R3 is turned on under the control of the signal of the third reset signal terminal Re3, so that the signal of the reference voltage signal terminal Vinit may be provided to the gate electrode of the drive transistor DT.

During specific implementation, the fifth switch transistor M5 is turned on under the control of a signal of the light emission control signal terminal EM, so that the first electrode of the drive transistor DT and the anode of the light emitting device L may be turned on, and the drive transistor DT may generate a drive current to drive the light emitting device L to emit light.

Optionally, as shown in FIG. 6, the pixel circuit provided in the embodiments of the present disclosure may further include: a sixth switch transistor M6.

A first electrode of the sixth switch transistor M6 is electrically connected to the first electrode of the drive transistor DT, a gate electrode of the sixth switch transistor M6 is electrically connected to a scanning signal terminal G, and a second electrode of the sixth switch transistor M6 is electrically connected to the gate electrode of the drive transistor DT.

During specific implementation, the sixth switch transistor M6 is turned on under the control of a signal of the scanning signal terminal G, so that the gate electrode and the first electrode of the drive transistor DT may be turned on.

Optionally, as shown in FIG. 6, the pixel circuit provided in the embodiments of the present disclosure may further include: a seventh switch transistor M7.

A first electrode of the seventh switch transistor M7 is electrically connected to a data signal terminal D, a gate electrode of the seventh switch transistor M7 is electrically connected to the scanning signal terminal G, and a second electrode of the seventh switch transistor M7 is electrically connected to a second electrode of the drive transistor DT.

During specific implementation, the seventh switch transistor M7 is turned on under the control of the signal of the scanning signal terminal G, so that the signal of the data signal terminal D may be provided to the second electrode of the drive transistor DT.

Optionally, as shown in FIG. 6, the pixel circuit provided in the embodiments of the present disclosure may further include: an eighth switch transistor M8.

A first electrode of the eighth switch transistor M8 is electrically connected to the first power supply terminal VDD, a gate electrode of the eighth switch transistor M8 is electrically connected to the light emission control signal terminal EM, and a second electrode of the eighth switch transistor M8 is electrically connected to the second electrode of the drive transistor DT.

During specific implementation, the eighth switch transistor M8 is turned on under the control of a signal of the light emission control signal terminal EM, so that the first power supply terminal VDD and the second electrode of the drive transistor DT may be turned on.

Optionally, the second reset signal terminal Re2 and the scanning signal terminal G may be the same terminal. Therefore, the number of signal terminals may be reduced and a wiring occupied space may be reduced.

Optionally, in the pixel circuit provided in the embodiments of the present disclosure, a difference between a maximum signal voltage Vi (max) of the reference voltage signal terminal Vinit and a minimum signal voltage VD (min) of the data signal terminal D is less than a threshold voltage Vth of the drive transistor DT: $Vi(max)-VD(min)<Vth$.

During specific implementation, in the pixel circuit provided in the embodiments of the present disclosure, as shown in FIG. 6, the fifth switch transistor M5 to the eighth switch transistor M8, the second reset transistor R2 and the third reset transistor R3 may all be P-type transistors, or may all be N-type transistors, which is not limited herein.

Specifically, in the pixel circuit provided in the embodiments of the present disclosure, the P-type transistors are turned on under low level signals and are turned off under high level signals, and the N-type transistors are turned on under high level signals and are turned off under low level signals.

Specifically, in the pixel circuit provided in the embodiments of the present disclosure, each of the transistors may be a thin TFT or a MOS field effect transistor, which is not limited herein. According to different types of the above transistors and different gate electrode signals of the transistors, the first electrode of each transistor may be used as a source electrode and a second electrode thereof may be used as a drain electrode, or the first electrode of each transistor is used as a drain electrode and the second electrode thereof is used as a source electrode, which are not specifically distinguished herein.

The present disclosure will be described in detail below in combination with specific embodiments. It should be noted that the embodiment is provided for better explanation of the present disclosure, but is not intended to limit the present disclosure. In the following description, 1 represents a high level and 0 represents a low level. It should be noted that 1 and 0 are logic levels, which are merely for better explanation of the specific working process of the pixel circuit, not specific voltage values. The signal voltage of the reference voltage signal terminal Vinit is Vi, the signal voltage of the data signal terminal D is VD, and the threshold voltage of the drive transistor DTDT is Vth.

Figure 7:
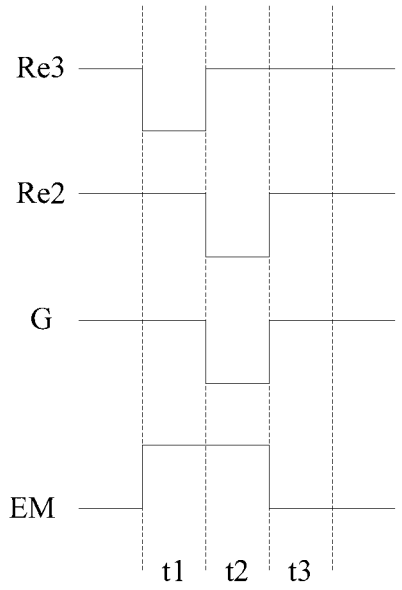
FIG. 7 is another signal timing diagram provided in an embodiment of the present disclosure.

With a structure of the pixel circuit shown in FIG. 6 as an example, a working process of the pixel circuit provided in the embodiments of the present disclosure will be described below in combination with a signal timing diagram shown in FIG. 7. Specifically, three stages, that is, a first stage t1, a second stage t2 and a third stage t3 in the signal timing diagram shown in FIG. 7 are selected.

In the first stage t1, Re3=0, Re2=1, G=1 and EM=1.

When Re3=0, the third reset transistor R3 is turned on; when Re2=1, the second reset transistor R2 is turned off; when G=1, the sixth switch transistor M6 and the seventh switch transistor M7 are turned off; when EM=1, the eighth switch transistor M8 and the fifth switch transistor M5 are turned off; and the third reset transistor R3 provides the signal of the reference voltage signal terminal Vinit to the gate electrode of the drive transistor DT to reset the gate electrode.

In the second stage t2, Re3=1, Re2=0, G=0 and EM=1.

when Re3=1, the third reset transistor R3 is turned off; when Re2=0, the second reset transistor R2 is turned on; when G=0, the sixth switch transistor M6 and the seventh switch transistor M7 are turned on; when EM=1, the eighth switch transistor M8 and the fifth switch transistor M5 are turned off; and the gate electrode and the first electrode of the drive transistor DT are turned on to form a diode, and the data signal terminal D charges the gate electrode of the drive transistor DT and the storage capacitor C2 until the gate electrode voltage of the drive transistor DT is VD+Vth, and the drive transistor DT is turned off. The second reset transistor R2 makes the second reset signal terminal Re2 and the anode of the light emitting device L turned on to reset the anode.

In the third stage t3, Re3=1, Re2=1, G=1 and EM=0.

When Re3=1, the third reset transistor R3 is turned off; when Re2=1, the second reset transistor R2 is turned off; when G=1, the sixth switch transistor M6 and the seventh switch transistor M7 are turned off; when EM=0, the eighth switch transistor M8 and the fifth switch transistor M5 are turned on; and the drive transistor DT generates a drive current under the control of the gate electrode voltage and a source electrode voltage of the drive transistor DT to enable the light emitting device L to emit light.

The drive current I satisfies the following formula:

$$I=K(Vgs-Vth)^2=K(VD+Vth-Vdd-Vth)^2=K(VD-Vdd)^2.$$

Wherein, $$K=\frac{1}{2}\mu_n C_{ox}\frac{W}{L},$$

$\mu_n$ represents a migration rate of the drive transistor DT, $$\frac{W}{L}$$

$C_{ox}$ represents a capacitance of a gate oxide layer per unit area, represents a width-length ratio of the drive transistor DT. In the same structure, these values are relatively stable and may be regarded as constants.

In the second stage t2, a signal voltage of the second reset signal terminal Re2 may be −6V. In a previous frame, a reserved anode voltage of the light emitting device L approximately ranges from −2.3V to 2V, a threshold voltage of the second reset transistor R2 is 0.5V, an anode voltage of the light emitting device L is reset to be −5.5V, a voltage of the second power supply terminal VSS is −3.5V, a voltage difference between a signal voltage of the second power supply terminal VSS and the anode voltage of the light emitting device L is 2V, and it is ensured that brightness of a black picture may be sufficiently low.

For example, a minimum signal voltage of the data signal terminal D may be 3V, a threshold voltage of the drive transistor DT may be −1V, and a maximum signal voltage of the reference voltage signal terminal Vinit may be less than 2V, for example, the signal voltage of the reference voltage signal terminal Vinit may be 1. V. In the third stage t3, a gate electrode voltage of the drive transistor DT is 2.3V, such that a voltage difference between two ends of the third reset transistor R3 is 0.8V, which is extremely low, and a leakage current of the third reset transistor R3 is extremely small, thereby overcoming the problem of a display defect caused by electric leakage of the third reset transistor R3.

Figure 8:
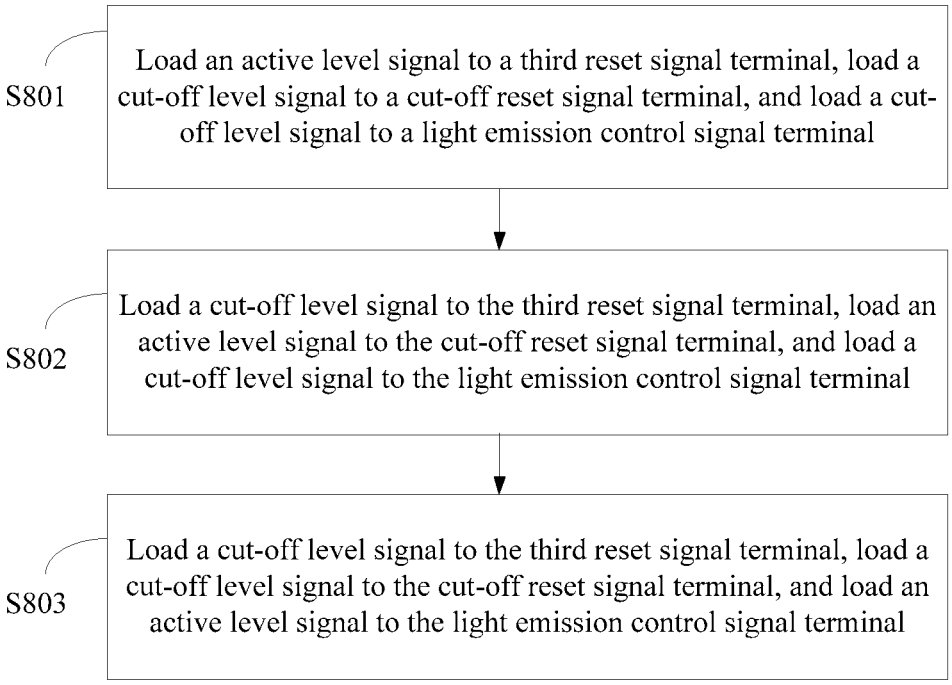
FIG. 8 is a flowchart of another driving method provided in an embodiment of the present disclosure.

On the basis of the same inventive concept, as shown in FIG. 8, the embodiment of the present disclosure further provides a driving method of the pixel circuit. The driving method includes S801 to S803.

S801, load an active level signal to a third reset signal terminal, load a cut-off level signal to a cut-off reset signal terminal and load a cut-off level signal to a light emission control signal terminal in a first stage.

S802, load a cut-off level signal to the third reset signal terminal, load an active level signal to the cut-off reset signal terminal and load a cut-off level signal to the light emission control signal terminal in a second stage.

S803, load a cut-off level signal to the third reset signal terminal, load a cut-off level signal to the cut-off reset signal terminal and load an active level signal to the light emission control signal terminal in a third stage.

Optionally, in the case that the pixel circuit further includes a sixth switch transistor M6 and a seventh switch transistor M7, the driving method may further include the following operations.

Load a cut-off level signal to a scanning signal terminal in the first stage.

Load an active level signal to the scanning signal terminal in the second stage.

Load a cut-off level signal to the scanning signal terminal in a third stage.

During specific implementation, the active levels may be high levels and the cut-off levels may be low levels, or the active levels are low levels and the cut-off levels are high levels.

On the basis of the same inventive concept, an embodiment of the present disclosure further provides a display apparatus. Implementation of the display apparatus may be obtained with reference to the above embodiment of the pixel circuit, and repetitions will not be described.

During specific implementation, the display apparatus may be a mobile phone, a tablet computer, a television, a monitor, a notebook computer, a digital photo frame, a navigator or other products or components with display functions. Other essential components of the display apparatus would be understood by those of ordinary skill in the art and will not be repeated herein, and should not be regarded as a limitation of the present disclosure.

According to the pixel circuit, the display apparatus and the driving method provided in the embodiments of the present disclosure, according to one kind of pixel circuit, the first switch transistor is arranged between the gate electrode of the drive transistor and the second electrode of the first reset transistor, such that the gate electrode of the drive transistor is not directly electrically connected to the first reset transistor, and the leakage current of the first reset transistor has a relatively small influence on the gate electrode signal of the drive transistor, thereby overcoming a display defect caused by the electric leakage of the first reset transistor. According to another kind of pixel circuit, the second reset transistor with a gate electrode and a first electrode short-circuited is arranged, such that reset of the anode of the light emitting device is only related to the signal of the second reset signal terminal. Therefore, by adjusting the signal voltage of the reference voltage signal terminal, the voltage difference between the two ends of the third reset transistor may be reduced, the leakage current of the third reset transistor may be reduced, and a display effect may be improved. Moreover, adjustment of the signal voltage of the reference voltage signal terminal may not influence the reset of the anode of the light emitting device.

Apparently, those skilled in the art can make various modifications and variations to the present disclosure without departing from the spirit and scope of the present disclosure. In this way, if these modifications and variations of the present disclosure fall within the scope of the claims of the present disclosure and equivalent technologies thereof, the present disclosure is further intended to include these modifications and variations.

What is claimed is:

1. A pixel circuit, comprising:

a drive transistor;

a storage capacitor, wherein a first electrode of the storage capacitor is electrically connected to a first power supply terminal, and a second electrode of the storage capacitor is electrically connected to a gate electrode of the drive transistor;

a light emitting device, wherein a cathode of the light emitting device is electrically connected to a second power supply terminal;

a fifth switch transistor, wherein a first electrode of the fifth switch transistor is electrically connected to a first electrode of the drive transistor, a gate electrode of the fifth switch transistor is electrically connected to a light emission control signal terminal, and a second electrode of the fifth switch transistor is electrically connected to an anode of the light emitting device;

a second reset transistor, wherein a gate electrode and a first electrode of the second reset transistor are both electrically connected to a second reset signal terminal, and a second electrode of the second reset transistor is electrically connected to the anode of the light emitting device; and a third reset transistor, wherein a first electrode of the third reset transistor is electrically connected to a reference voltage signal terminal, a gate electrode of the third reset transistor is electrically connected to a third reset signal terminal, and a second electrode of the third reset transistor is electrically connected to the gate electrode of the drive transistor;

wherein a voltage change of the reference voltage signal terminal is independent of the second reset transistor.

2. The pixel circuit according to claim 1, further comprising:

a sixth switch transistor, wherein a first electrode of the sixth switch transistor is electrically connected to the first electrode of the drive transistor, a gate electrode of the sixth switch transistor is electrically connected to a scanning signal terminal, and a second electrode of the sixth switch transistor is electrically connected to the gate electrode of the drive transistor.

3. The pixel circuit according to claim 2, further comprising:

an eighth switch transistor, wherein a first electrode of the eighth switch transistor is electrically connected to the first power supply terminal, a gate electrode of the eighth switch transistor is electrically connected to the light emission control signal terminal, and a second electrode of the eighth switch transistor is electrically connected to a second electrode of the drive transistor.

4. The pixel circuit according to claim 1, further comprising:

a seventh switch transistor, wherein a first electrode of the seventh switch transistor is electrically connected to a data signal terminal, a gate electrode of the seventh switch transistor is electrically connected to the scanning signal terminal, and a second electrode of the seventh switch transistor is electrically connected to a second electrode of the drive transistor.

5. The pixel circuit according to claim 4, wherein a difference between a maximum signal voltage of the reference voltage signal terminal and a minimum signal voltage of the data signal terminal is less than a threshold voltage of the drive transistor.

6. The pixel circuit according to claim 4, further comprising:

an eighth switch transistor, wherein a first electrode of the eighth switch transistor is electrically connected to the first power supply terminal, a gate electrode of the eighth switch transistor is electrically connected to the light emission control signal terminal, and a second electrode of the eighth switch transistor is electrically connected to a second electrode of the drive transistor.

7. The pixel circuit according to claim 1, further comprising:

an eighth switch transistor, wherein a first electrode of the eighth switch transistor is electrically connected to the first power supply terminal, a gate electrode of the eighth switch transistor is electrically connected to the light emission control signal terminal, and a second electrode of the eighth switch transistor is electrically connected to a second electrode of the drive transistor.

8. A driving method of the pixel circuit according to claim 1, comprising:

in a first stage, loading an active level signal to the third reset signal terminal, loading a cut-off level signal to the second reset signal terminal and loading a cut-off level signal to the light emission control signal terminal;

in a second stage, loading a cut-off level signal to the third reset signal terminal, loading an active level signal to the second reset signal terminal and loading a cut-off level signal to the light emission control signal terminal; and in a third stage, loading a cut-off level signal to the third reset signal terminal, loading a cut-off level signal to the second reset signal terminal and loading an active level signal to the light emission control signal terminal.

9. The driving method according to claim 8, further comprising:

in the first stage, loading a cut-off level signal to a scanning signal terminal;

in the second stage, loading an active level signal to the scanning signal terminal; and in the third stage, loading a cut-off level signal to the scanning signal terminal.

10. A display apparatus, comprising a pixel circuit, wherein the pixel circuit comprises:

a drive transistor;

a storage capacitor, wherein a first electrode of the storage capacitor is electrically connected to a first power supply terminal, and a second electrode of the storage capacitor is electrically connected to a gate electrode of the drive transistor;

a light emitting device, wherein a cathode of the light emitting device is electrically connected to a second power supply terminal;

a fifth switch transistor, wherein a first electrode of the fifth switch transistor is electrically connected to a first electrode of the drive transistor, a gate electrode of the fifth switch transistor is electrically connected to a light emission control signal terminal, and a second electrode of the fifth switch transistor is electrically connected to an anode of the light emitting device;

a second reset transistor, wherein a gate electrode and a first electrode of the second reset transistor are both electrically connected to a second reset signal terminal, and a second electrode of the second reset transistor is electrically connected to the anode of the light emitting device; and a third reset transistor, wherein a first electrode of the third reset transistor is electrically connected to a reference voltage signal terminal, a gate electrode of the third reset transistor is electrically connected to a third reset signal terminal, and a second electrode of the third reset transistor is electrically connected to the gate electrode of the drive transistor;

wherein a voltage change of the reference voltage signal terminal is independent of the second reset transistor.

11. The display apparatus according to claim 10, wherein the pixel circuit further comprises:

a sixth switch transistor, wherein a first electrode of the sixth switch transistor is electrically connected to the first electrode of the drive transistor, a gate electrode of the sixth switch transistor is electrically connected to a scanning signal terminal, and a second electrode of the sixth switch transistor is electrically connected to the gate electrode of the drive transistor.

12. The display apparatus according to claim 10, wherein the pixel circuit further comprises:

a seventh switch transistor, wherein a first electrode of the seventh switch transistor is electrically connected to a data signal terminal, a gate electrode of the seventh switch transistor is electrically connected to the scanning signal terminal, and a second electrode of the seventh switch transistor is electrically connected to a second electrode of the drive transistor.

13. The display apparatus according to claim 12, wherein a difference between a maximum signal voltage of the reference voltage signal terminal and a minimum signal voltage of the data signal terminal is less than a threshold voltage of the drive transistor.

14. The display apparatus according to claim 10, wherein the pixel circuit further comprises:

an eighth switch transistor, wherein a first electrode of the eighth switch transistor is electrically connected to the first power supply terminal, a gate electrode of the eighth switch transistor is electrically connected to the light emission control signal terminal, and a second electrode of the eighth switch transistor is electrically connected to a second electrode of the drive transistor.

* * * * *